United States Patent [19]

Liebert

[11] 4,295,805

[45] Oct. 20, 1981

[54] HYDRAULIC ROTARY TOOTHED PISTON ENGINE WITH FLOW THROUGH THE TOOTHED GAPS

[75] Inventor: Karl-Heinz Liebert, Schwabisch Gmund, Fed. Rep. of Germany

[73] Assignee: Zahnradfabrik Friedrichshafen, AG., Friedrichshafen, Fed. Rep. of Germany

[21] Appl. No.: 84,183

[22] Filed: Oct. 12, 1979

[30] Foreign Application Priority Data

Oct. 20, 1978 [DE] Fed. Rep. of Germany ..... 2845648

[51] Int. Cl.[3] ..... F03C 2/08; F04C 2/10; F04C 15/02

[52] U.S. Cl. ..... 418/61 B

[58] Field of Search ..... 418/61 B; 60/384, 386; 91/375 R, 467

[56] References Cited

U.S. PATENT DOCUMENTS

| | | | |
|---|---|---|---|
| 3,452,680 | 7/1969 | White, Jr. | 418/61 B |
| 3,481,147 | 12/1969 | Goff | 60/384 |
| 3,873,248 | 3/1975 | Johnson | 418/61 B |

*Primary Examiner*—John J. Vrablik

*Attorney, Agent, or Firm*—Zalkind & Shuster

[57] ABSTRACT

Axial flow paths are established between the ring gear of a rotatable fluid displacing device and the housing of an associated control valve by radial clearance passages formed in the ring gear and spacer in axial alignment with axial flow passages of the housing through which threaded fastener shanks extend to hold the ring gear, spacer and housing assembled. The gaps between the internal teeth of the ring gear are radially extended to receive the fasteners therethrough with a close assembly clearance along radially outer portions of the fastener shanks.

4 Claims, 4 Drawing Figures

HYDRAULIC ROTARY TOOTHED PISTON ENGINE WITH FLOW THROUGH THE TOOTHED GAPS

BACKGROUND OF THE INVENTION

This invention relates to rotatable fluid displacing devices of the meshing gear type and is an improvement over such a device as disclosed in prior German application No. P 27 18 148.2-15 owned by the assignee of the present application.

A fluid displacing device of the foregoing type is operative either as a pump or a motor and is particularly useful as part of a hydrostatic steering system for automotive vehicles. When applied to a hydrostatic steering system, the fluid displacing device is generally attached to the steering control valve housing by means of threaded fasteners extending from an end cover assembled onto an axial end of the valve housing. According to the structural arrangement disclosed for example in applicant's prior German application No. P 28 10 902.6-21, longitudinal flow passages are formed in the valve housing by bores into which the fasteners extend with radial flow clearance. During operation of the fluid displacing device, about half of the flow passages conduct flow to or from the volumetrically decreasing fluid displacing pockets of the fluid displacing device while the other flow passages conduct flow to or from the volumetrically increasing fluid displacing pockets. Further, the valve housing is provided with additional passages for check valves and to conduct fluid in connection with the use of the fluid displacing device as a flow metering motor in a hydrostatic steering system. By utilizing flow passages in the housing surrounding the shanks of the fasteners interconnecting the housing with the fluid displacing device, more room is available within the housing for the formation of the additional passages required in connection with various installations. The fasteners according to prior art arrangements always extend through the radially outer ring gear between the gaps of its internal teeth. A spacer disposed between the fluid displacing device and the valve housing seals the fluid displacing pockets and is provided with radial flow openings through which operating fluid is transferred between the tooth gaps of the outer ring gear and the longitudinal passages in the valve housing surrounding the shank of the fasteners. Such flow paths offer a relatively high flow resistance since the operating fluid undergoes a change in direction twice; first when being conducted in an axial direction from the tooth gaps to a radial direction within the flow passages in the spacer; and second from the radial direction of flow within the spacer to the axially extending passages within the valve housing. The manufacture of the spacer through which the flow passages extend is quite costly since it requires special machining. Where the spacer is produced by a sintering process, a special tool is required to form the flow passages. Further, since the spacer must be dimensioned for a tight fit in its installation, plastic or copper inserts are utilized making production of the spacer even more expensive.

It is therefore an important object of the present invention to provide an assembly of a fluid displacing device and steering control valve of the aforementioned type having a sealing spacer between the fluid displacing device and the valve housing through which flow may be conducted without directional change in order to reduce frictional flow resistance and to enable production of the spacer in a less costly manner.

SUMMARY OF THE INVENTION

In accordance with the present invention, the fluid displacing device as hereinbefore described is modified so that the circumferentially spaced gaps between the internal teeth of the outer ring gear in the fluid displacing device are radially extended. The shanks of the fasteners extend through such extensions of the gaps to form flow-through clearance passages in substantial axial alignment with axial flow openings in the spacer partially surrounding the shanks. The radially outer portions of the gap extensions within the outer ring gear and the axial flow openings in the spacer, conform to radially outer portions of the fastener shanks with less clearance sufficient merely to enable insertion and threaded tightening of the fasteners. Centering of the spacer and assembly of the parts is thereby facilitated.

The essential feature of the present invention resides in the extension of the fastener shank through the radial extensions of the tooth gaps in the outer ring gear of the fluid displacing device enabling fluid to be conducted through axially aligned flow openings in the spacer into the longitudinal passages of the valve housing without any directional change. As a result of the foregoing arrangement, fluid flow resistance is maintained low. Furthermore, the spacer element may be produced inexpensively as a simply stamped metal part, for example.

By virtue of the closer radial assembly clearance between the fastener shanks and the radially outer portions of the extended tooth gaps in the outer ring gear and in the axially aligned flow openings of the spacer, the components may be more readily guided into proper position for assembly.

BRIEF DESCRIPTION OF DRAWINGS

A specific embodiment of the invention is hereinafter described with reference to the accompanying drawings, in which.

DETAILED DESCRIPTION OF PREFERRED EMBODIMENT

Figure 1:
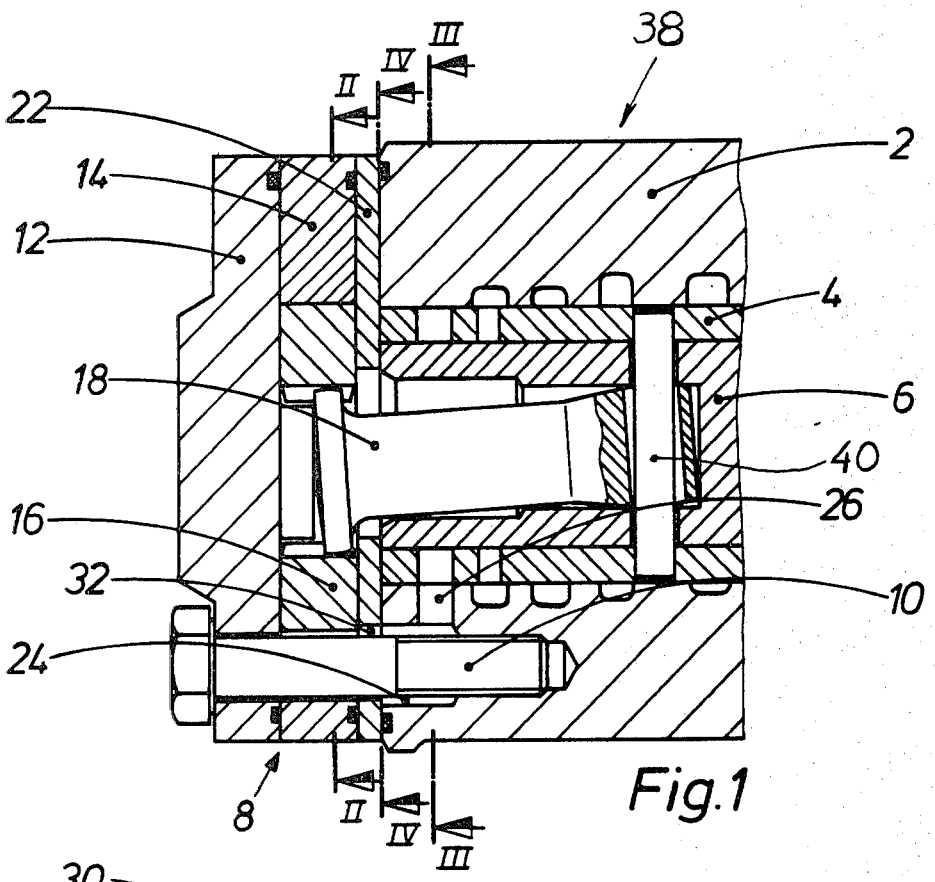
FIG. 1 is a side section view through a rotatable fluid displacing device and a portion of an associated steering control valve.

Referring now to the drawings in detail, FIG. 1 illustrates a combined steering control valve and fluid displacer assembly generally referred to by reference numeral 38 which includes a valve housing 2 within which a radially outer sleeve valve element 4 is mounted in concentric relation to an inner control valve element 6. In response to angular displacement of the inner valve element 6 relative to the outer valve element 4, fluid flow distribution is effected in a manner well known in the art. Secured to the left end of the housing 2 as viewed in FIG. 1, by means of the threaded fasteners 10, is a fluid displacing device generally referred to by reference numeral 8. The fluid displacing device has an end cover 12 through which the fasteners 10 extend for threaded connection to the housing 2, a radially outer ring gear 14 having internal teeth and a radially inner gear 16 having external teeth in mesh with the internal teeth. The inner gear 16 is rotatable within the outer ring gear 14 in eccentric relation thereto and is torsionally connected by an elastic shaft 18 and a swivel pin 40 to the inner control valve element 4. Formed between the teeth of the outer ring gear 14 and the inner gear 16 are fluid displacing pockets 20 sealed from each other. The pockets 20 are enclosed within the ring gear 16 by means of a spacer 22 which is positioned axially between the end face of the housing 2 and the gears 14 and 16. Passages 24 formed in the housing 2 parallel to its longitudinal axis are in fluid communication with the fluid displacing pockets 20 through axial flow openings 32 in the spacer 22. The passages 24 and openings 32 are formed as radial flow clearance about the shanks of the fasteners 10. The passages 24 are in fluid communication with the outer control valve element through radial passages 26. The valve elements 4 and 6 thereby control the flow of fluid between the fluid displacing pockets 20 and valve passages formed in the housing 2 in a manner generally well known in the art, similar to that disclosed in prior German application No. P 28 10 902.6, owned by the assignee of the present application.

Figure 2:
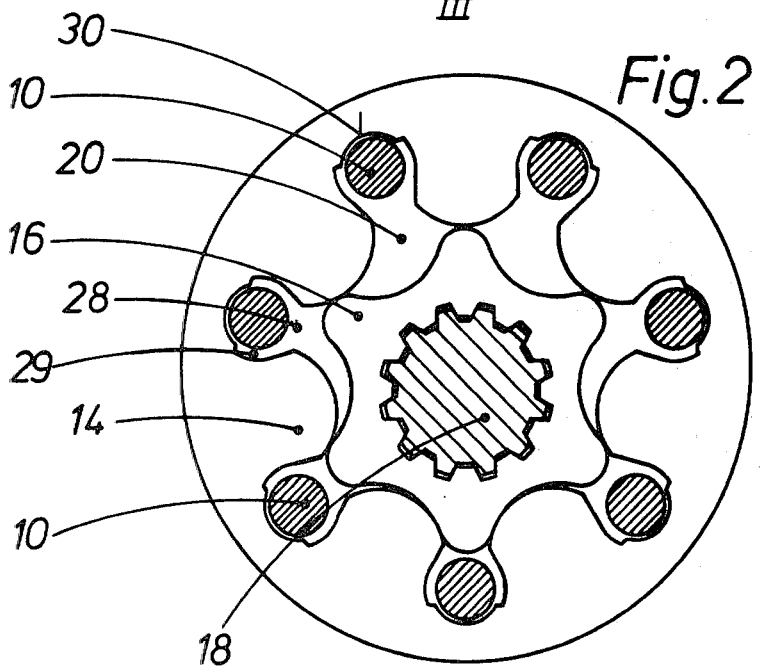
FIG. 2 is a transverse section view taken substantially through a plane indicated by section line 2—2 in FIG. 1.
Figure 4:
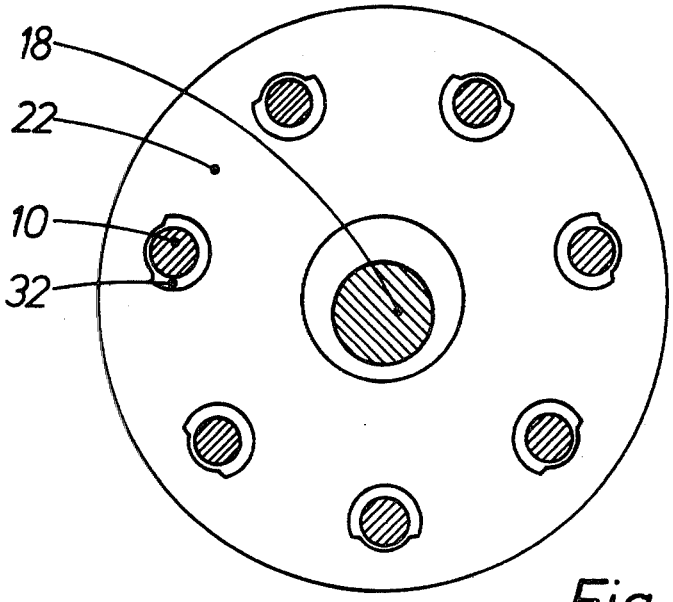
FIG. 4 is a transverse section view taken substantially through a plane indicated by section line 4—4 in FIG. 1.

The shanks of the fasteners 10 extend through the outer ring gear 14 within extensions 28 of the fluid displacing pockets 20 between the internal teeth of the ring gear. Radial clearance gaps 29 are formed partially about the fastener shanks sufficient to enable axial flow of fluid as more clearly seen in FIG. 2. The radial extension gaps 29 do not extend completely about the fastener shanks. Instead, the fastener shanks extend through the outer ring gear with only enough clearance relative to the radially outer portions 30 of the extensions 28 to enable insertion and threaded tightening of the fasteners. The flow openings 32 within the spacer 22 are axially aligned with the radial extension gaps 29 in the outer ring gear 14 and likewise partially surround the shanks of the fasteners 10 with less clearance at the radially outer portions of the shanks as more clearly seen in FIG. 4.

During operation, operating fluid may readily flow from one fluid displacement pocket 20 into the flow-through gaps 29 formed in the outer ring gear 14 and then continue to flow without restriction through the axial flow openings 32 in the spacer 22 into the longitudinal passages 24 within the housing 2 in surrounding relation to the shanks of the fasteners 10. The fluid is conducted from the passages 24 through passages 26 to the outer valve element 4. Flow of fluid from the valve elements may proceed in a reverse direction through the passages 26 and 24, openings 32 and gaps 29 into the fluid displacing pockets 20. Thus, the fluid displacing device 8 will have a dual function in operating either as a pump or as a motor.

Figure 3:
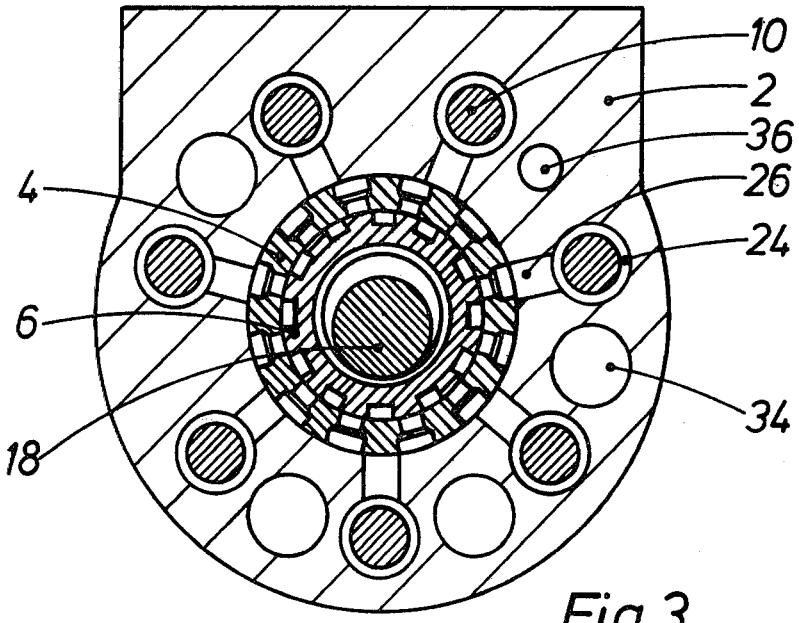
FIG. 3 is a transverse section view taken substantially through a plane indicated by section line 3—3 in FIG. 1.

As more clearly seen in FIG. 3, additional passages 34 and 36 are formed in the housing between the passages 24 surrounding the fasteners 10 for the purpose of mounting check valves or to form connecting passages as required in connection with hydrostatic steering systems, wherein the fluid displacing device 8 functions as a fluid metering motor.

The invention as hereinbefore described may also be applied to a control valve assembly in which the valve elements are of the axial slide type rather than the rotatable type. Further, the invention may be utilized for a valve assembly having a single control valve element, in which case the rotatable fluid displacing device has a single function in operating either as a pump or as a motor.

What is claimed is:

1. In a combined fluid displacing device (8) and control valve assembly having a radially outer ring gear (14) provided with internal teeth spaced from each other by gaps in fluid communication with fluid displacing pockets formed between said ring gear and an inner member (20), valve means a valve housing therefor (2) within which axial flow passages (24) are formed, a fixed spacer (22) positioned axially between the ring gear and the housing and elongated assembly fasteners (10) extending through the ring gear and the spacer into the valve housing through the axial flow passages therein, the improvement residing in said ring gear being formed with radial extensions (28) of said gaps between the internal teeth receiving the fasteners therethrough with flow clearance in substantial axial alignment with the axial flow passages in the valve housing, said spacer being formed with axial flow openings (32) through which the fasteners extend with partial radial clearance to conduct axial flow between the radial gap extensions and the axial flow passages in the housing without directional change with the fluid flow being into and out of said fluid displacing pockets through said gaps, radial gap extensions, openings, axial flow passages and valve means.

2. The combination of claim 1, wherein said radial gap extensions (28) receive the fasteners with assembly clearance (30) along radially outer portions thereof substantially less than the flow clearance.

3. In a rotatable fluid displacing device for a hydrostatic steering system or the like including a housing (2) having a valve element (4) therein and longitudinal passages (24) in fluid communication therewith, a radially outer ring gear (14) having internal teeth and gaps therebetween, a radially inner gear (16) rotatable with the valve element and having external teeth differing in number from the internal teeth, said internal and external teeth being enmeshed with each other and forming separated fluid displacing pockets (20) therebetween in fluid communication with the gaps, fixed spacer means (22) positioned between the housing and the outer ring gear and the inner gear for enclosing the fluid displacing pockets and having openings (32) establishing fluid communication between the gaps and the longitudinal passages and elongated threaded fasteners (10) extending through the outer ring gear, the spacer means and the longitudinal passages in the housing to hold the outer ring gear, the spacer means and the housing assembled, said outer ring gear being formed with radial extensions (28) of the gaps through which said fasteners extend with radial clearance to form flow-through passages (29), said openings in the spacer means being substantially aligned axially between the flow-through passages in the outer ring gear and the longitudinal passages in the housing to avoid directional change in flow therethrough with the fluid flow being into and out of said fluid displacing pockets through said gaps, flow through passages, openings, longitudinal passages and valve element.

4. The fluid displacing device as defined in claim 3, wherein the openings (32) in the spacer means provide partial radial clearance about the fasteners through which axial flow is conducted except for radially outer portions of the fasteners.

* * * * *